US009103635B1

(12) United States Patent
Calvert

(10) Patent No.: US 9,103,635 B1
(45) Date of Patent: Aug. 11, 2015

(54) PIEZOELECTRIC PEBBLE EXPLOSIVE

(71) Applicant: PBE Associates, Trustee for Piezoelectric pebble explosive CRT Trust, Manassas, VA (US)

(72) Inventor: S. Mill Calvert, Manassas, VA (US)

(73) Assignee: PBE Associates, Trustee for Piezoelectric pebble explosive CRT Trust, Manassas, VA (US)

( * ) Notice: Subject to any disclaimer, the term of this patent is extended or adjusted under 35 U.S.C. 154(b) by 0 days.

(21) Appl. No.: 14/572,121

(22) Filed: Dec. 16, 2014

(51) Int. Cl.

| | |
|---|---|
| ***F42C 11/02*** | (2006.01) |
| ***F42B 3/10*** | (2006.01) |
| ***F42B 3/28*** | (2006.01) |
| ***F42B 23/10*** | (2006.01) |
| ***F42B 23/24*** | (2006.01) |

(52) U.S. Cl.
CPC . *F42B 3/10* (2013.01); *F42B 23/10* (2013.01); *F42B 23/24* (2013.01); *F42C 11/02* (2013.01)

(58) Field of Classification Search
CPC ..... F42C 11/02; F42C 11/007; F42C 11/008; F42B 23/00; F42B 23/04; F42B 23/10; F42B 23/24; F42B 3/00; F42B 3/10; F42B 3/28; F23Q 3/002
USPC ..... 102/210, 314, 322, 331, 332, 416, 419, 102/421, 428
See application file for complete search history.

(56) References Cited

U.S. PATENT DOCUMENTS

| | | | | |
|---|---|---|---|---|
| 2,892,411 | A * | 6/1959 | Brown et al. | 102/210 |
| 3,202,100 | A * | 8/1965 | Vilbajo | 102/210 |
| 3,585,419 | A * | 6/1971 | Andre | 310/339 |
| 3,703,867 | A | 11/1972 | Madlener et al. | |
| 3,842,742 | A * | 10/1974 | Harnau | 102/210 |
| 3,859,746 | A | 1/1975 | Pecksen | |
| 4,368,670 | A | 1/1983 | Weidner | |
| 4,648,320 | A | 3/1987 | Furst et al. | |
| 4,723,087 | A * | 2/1988 | Fox et al. | 310/329 |
| 5,904,443 | A | 5/1999 | Soleau | |
| 7,011,470 | B1 | 3/2006 | Breazeale et al. | |

FOREIGN PATENT DOCUMENTS

EP 534840 A1 * 3/1993

* cited by examiner

*Primary Examiner* — James S Bergin
(74) *Attorney, Agent, or Firm* — Louis Ventre, Jr.

(57) ABSTRACT

An explosive device includes a hollow container having an inner volume holding an explosive. A piezoelectric ceramic connected to the container also has an electrical connection to the explosive. A deformation of the container applies mechanical stress to the piezoelectric ceramic which produces a potential difference or an electric current discharged using the electrical connection. The discharge detonates the explosive. The piezoelectric ceramic may be inside the container or on an outer surface and may be later inserted into the container to arm the explosive device. The container may have an outer surface that is an electrical insulator to prevent accidental electrostatic detonation. The explosive is optionally a plastic explosive. The electrical connection to the explosive optionally includes electrical conductors spaced apart to form a gap that is dimensioned to enable a spark to cross the gap when the piezoelectric ceramic deforms a predesignated amount.

7 Claims, 4 Drawing Sheets

PIEZOELECTRIC PEBBLE EXPLOSIVE

TECHNICAL FIELD

In the field of ammunition and explosives, a piezoelectric explosive device that may be strewn on the ground for later activation when walking or driving on them adds a compressive force.

BACKGROUND ART

The piezoelectric effect was discovered in 1880 when two scientists realized that pressure can generate electrical charges in a number of crystals, such as quartz, Rochelle salt and tourmaline. Pressure applied to the crystals generates electrical charges on the surface of piezoelectric materials. This is a direct piezoelectric effect, which is also called generator or sensor effect. It converts mechanical energy into electrical energy.

Because the early crystals did not develop a significant charge, there was little use of piezoelectric materials until a breakthrough was made in the discovery that polycrystalline ferroelectric ceramics such as barium titanate ($BaTiO_3$) and lead zirconium titanate (PZT) induce piezoelectric characteristics on a useful scale. Special dopings of the PZT ceramics with e.g. Ni, Bi, La, Nd, Nb ions make it possible to specifically optimize piezoelectric and dielectric parameters. These polycrystalline ferroelectric ceramics led to numerous present day components that utilize the piezoelectric effect, such as lighters, loudspeakers and signal transducers.

The theory of how piezoelectric ceramics work teaches that mechanical stresses arising as the result of an external force that act on the piezoelectric body induce displacements of electrical dipoles within the piezoelectric ceramics. This generates an electric field, which produces a corresponding electric voltage. This direct piezoelectric effect is also called the sensor or generator effect, which can be used to ignite an explosive.

In the long history of the technology of warfare, a key turning point was the invention of gunpowder and various explosions. This was a quantum leap forward past the club; the sword, knife, and spear; and the bow and arrow. Now military planners could blow things up and harness explosive forces to propel projectiles toward the enemy.

When it comes to military explosives, one of the very important factors is the technological means used to detonate the explosive material. One of the primary detonation materials developed years ago in construction and mining industries was to have very long electrically conductive wires that would connect to the explosive and the other end would be connected to a charge plunger device that was safely far away. This charge plunger method is still in use today because it gives you specific timing control as to when you want the explosion to occur.

Other methods have been developed to have specific control of the timing of the explosion, which usually involves various types of wireless signals sent to a device that will then trigger the explosion. Many times in military situations these types of wireless detonators can be dangerous or unreliable because the enemy can either block the signal or send a signal of its own to cause an unwanted explosion.

SUMMARY OF INVENTION

An explosive device includes a hollow container having an inner volume holding an explosive. A piezoelectric ceramic connected to the container also has an electrical connection to the explosive. A deformation of the container applies mechanical stress to the piezoelectric ceramic which produces a potential difference or an electric current discharged using the electrical connection. The discharge detonates the explosive. The piezoelectric ceramic may be inside the container or on an outer surface and may be later inserted into the container to arm the explosive device. The container may have an outer surface that is an electrical insulator to prevent accidental electrostatic detonation. The explosive is optionally a plastic explosive. The electrical connection to the explosive optionally includes electrical conductors spaced apart to form a gap that is dimensioned to enable a spark to cross the gap when the piezoelectric ceramic deforms a predesignated amount.

Technical Problem

Even though the wires connected to a detonation plunger are the most reliable to control explosion timing, in many military situations this is just not practical. In many military situations, you want to coordinate the explosive timing to a specific event when the enemy takes action and begins to move. They could move their troops, move their tanks, move their aircrafts, move their vehicles, etc.

Since it is usually not possible to have an observer watch the enemy and manually trigger the explosion at just the right moment, it would be of great military benefit if there were a new technology that could be quickly and easily strewn over the ground surface, would be virtually unnoticeable over existing ground cover and that by itself would cause the detonator to happen at the ideal times based on the enemy's own movements.

Solution to Problem

The technological solution is the piezoelectric pebble explosive, which uses the compressive ability of piezoelectric crystals to generate a charge that will detonate the explosive material they are fastened to. Any movement or activity by the enemy that can create a compressive force can trigger the explosion from the hidden explosive within the piezoelectric pebble explosive.

The movement of a vehicle or aircraft tire, the movement of a tank tread, the weight of enemy soldiers walking on the surface of the ground, the recoil of an enemy weapon, a door being closed on an enemy vehicle, a seat that the enemy sits on, or a bed he lays down in: There is no limit to the amount of places that piezoelectric pebble explosive can be used to have the enemy's own movements trigger the explosion.

Advantageous Effects of Invention

The piezoelectric pebble explosive may be provided in different shapes, sizes, and explosive force levels. It can be in a small pellet size that can be placed under an airplane tire or thrown out of the window to explode the tires of an enemy vehicle in pursuit. It can be of a larger block size or a layered stick-on tape size that can be peeled off a roll and stuck to an object. It can be the size of a land mine or an improvised explosive device.

The piezoelectric pebble explosive can have a peel-off strip with a sticky side to stick it to an object or stick several piezoelectric pebble explosives together for a larger explosion. A piezoelectric pebble explosive can also be placed onto a larger amount of explosive material and act as the compression detonator. The piezoelectric pebble explosive can also come in a dough-type pliable shape moldable container when applications needing a shaped charge are intended.

One of the military and covert benefits of piezoelectric pebble explosive is that there is not a great deal of metal structure that can be picked up by a metal detector or land mine sweeper locator. The piezoelectric ceramic and the explosive material are not metal and there is not a lot of the other metal components that all other explosive devices have. An undercover agent could easily pass through a security checkpoint to take piezoelectric pebble explosive to the enemy location. A piezoelectric pebble explosive device, unlike a land mine, is not easy to locate with a metal detector.

Piezoelectric pebble explosive opens many new possibilities in warfare for the motion and movement of the enemy to be used against them.

Piezoelectric pebble explosive will be a valuable new tool to help win the War on Terror.

BRIEF DESCRIPTION OF DRAWINGS

The drawings illustrate preferred embodiments of the piezoelectric pebble explosive according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the explosive device of the present invention. The drawings and the preferred embodiments of the invention are presented with the understanding that the present invention is susceptible of embodiments in many different forms and, therefore, other embodiments may be utilized and structural, and operational changes may be made without departing from the scope of the present invention.

Figure 1:
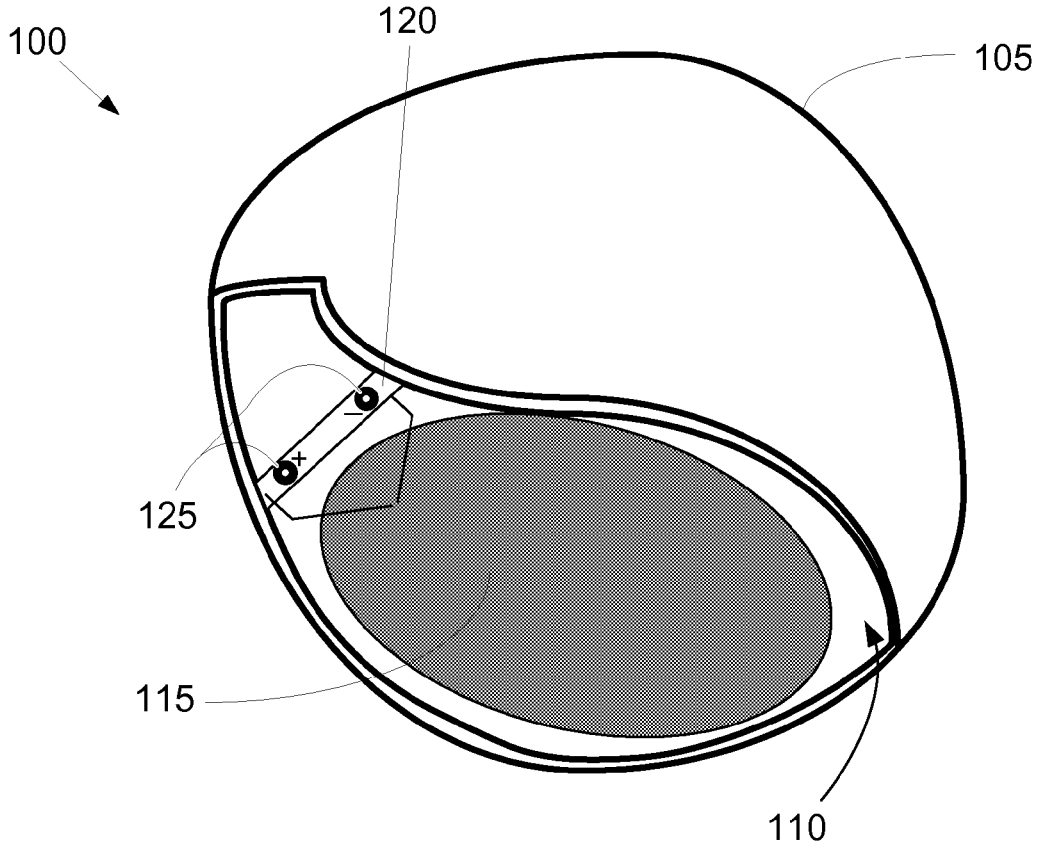
FIG. 1 is a cutaway perspective of a container showing components of a preferred embodiment of an explosive device, namely the piezoelectric pebble explosive.

A preferred embodiment of the piezoelectric pebble explosive is shown in FIG. 1. It is an explosive device (100) that includes a container (105), an explosive (115) and a piezoelectric ceramic (120).

Figure 4:
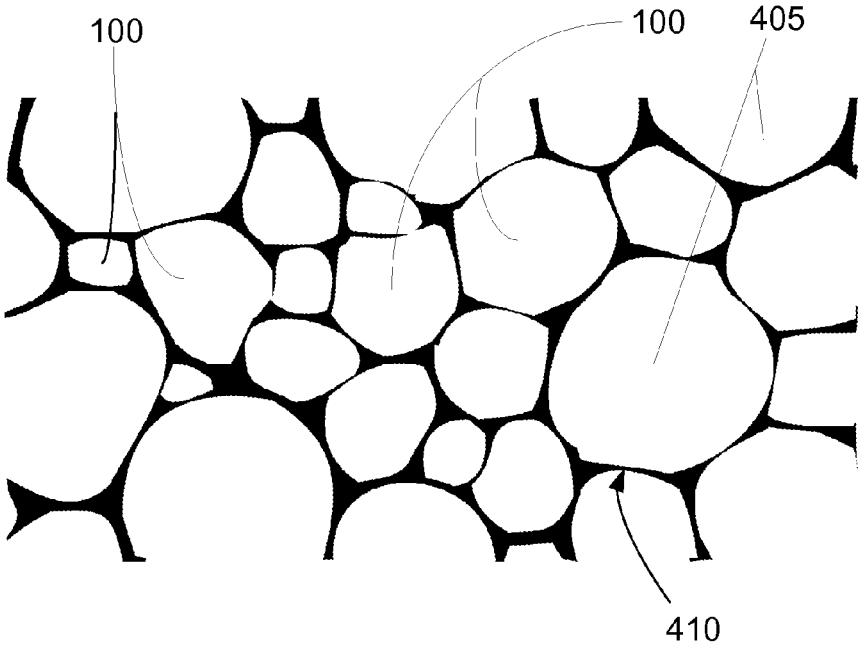
FIG. 4 is a top view of four explosive devices strewn among other rocks along a path.

The explosive device (100) is preferably in the form of a pebble. The term pebble is used herein and is defined broadly to include a rock (405) or other large naturally-formed solid mineral material forming part of the surface of the earth. The external shape of the container (105) is a structural feature that will disguise the explosive device (100) when it is laid atop the ground, that is when it is deployed, so that it will not stand out or be recognizable to a terrorist or other enemy as an explosive device among other ground cover. FIG. 4 illustrates such a deployment.

The container (105) is a hollow object structured with an irregular shape (410) of a rock (405) that is used to hold the explosive (115). Thus, the container (105) is a shell that defines an inner volume (110). The shell is preferably non-metallic and made in whole or in part of an electrical insulator, such as plastic, to lower the potential for the explosive device (100) to prematurely detonate from external static discharges. The shell may be made of a pliable material or a hard material.

Figure 2:
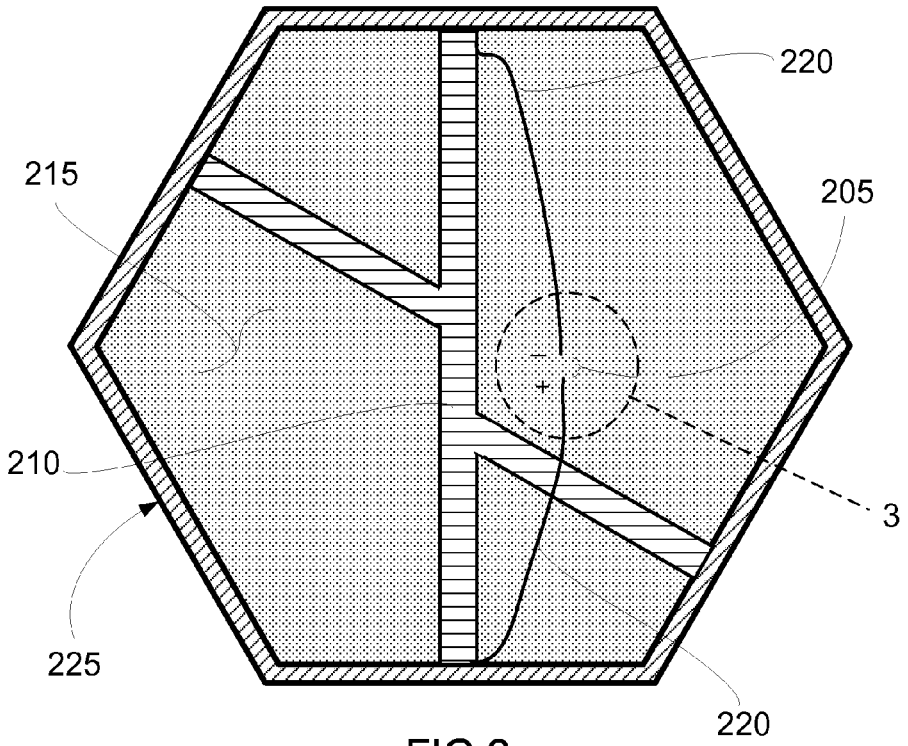
FIG. 2 is a sectional elevation view of a hexagonal pebble showing components of an alternative embodiment of the piezoelectric pebble explosive.
Figure 3:
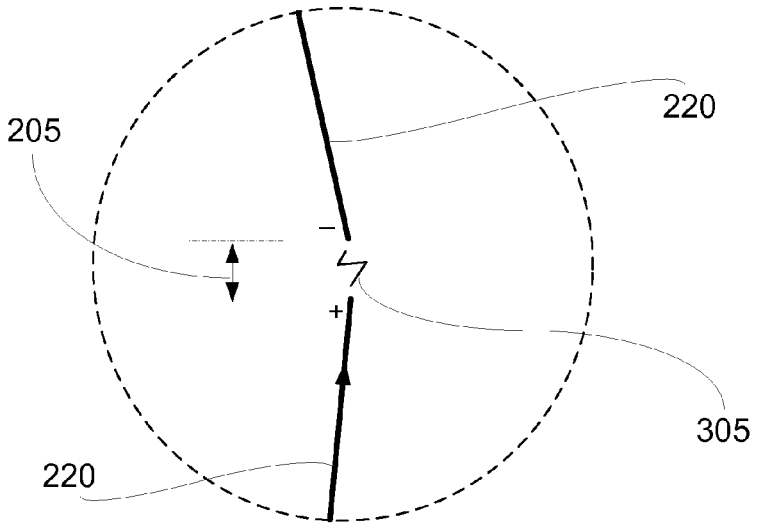
FIG. 3 is a partial view of electrical conductors forming a gap and showing a spark in the gap.

A piezoelectric ceramic (120) can be made thin, (e.g. 0.02 inches thick) and so can be used as a sheet covering all or a part of the shell. Alternatively, the piezoelectric ceramic (120) may be a multilayer piezo device (210) as shown in FIG. 2. Alternatively, as in FIG. 5, the shell may be partially made from a piezoelectric ceramic (120). Alternatively, the shell may be wholly made from a piezoelectric ceramic (120). In all preferred alternatives, any deformation of the shell also compresses or stresses the piezoelectric ceramic (120). When the shell is a hard material, it is preferable that any bending of the shell directly compresses the piezoelectric ceramic (120) and generates an electrical potential difference or an electric current (505).

The explosive (115) is within the inner volume (110), that is, the explosive (115) is enclosed within the container (105), preferably fully enclosed by the shell to protect it from the elements. Such an arrangement permits the explosive (115) to have many forms. For example, a liquid explosive, such as nitroglycerin, could be further contained in vials within the inner volume (110). However, due to its timed degradation, high freezing point and instability, the applications are more limited and careful handling is required. Alternatively, a plastic explosive (215) may simply be formed to the shape of the inner volume or occupy less than the entire inner volume. Plastic explosives, such as C-4 and SEMTEX, can be easily formed and have a high enough velocity of detonation and density for destroying metal, such as in a vehicle rolling over the explosive device (100). Gun powder is a third example of an explosive (115). Gun powder being granular may be poured into the container (105) so that it partially or fully occupies the inner volume (110) or be contained within smaller packages within the container (105).

The piezoelectric ceramic (120) has an electrical connection (125) to the explosive (115) so that either current flows through the explosive (115) or a spark is created across a gap (205) to initiate detonation of the explosive (115). The electrical connection (125) comprises electrical terminals on the piezoelectric ceramic (120).

Preferably, the piezoelectric ceramic (120) is a polycrystalline ferroelectric ceramic such as barium titanate ($BaTiO_3$) or lead zirconate titanate (PZT). These can be formed in many shapes and are preferred because they exhibit the largest electric voltages from applied mechanical stress as compared to other piezoelectric materials such as quartz and tourmaline.

The piezoelectric ceramic (120) is mechanically, that is structurally, connected to the container (105), and more specifically to its shell, so that a deformation of the container (105), and more specifically a deformation of the shell, applies mechanical stress to the piezoelectric ceramic (120). This mechanical stress on the piezoelectric ceramic (120) causes the piezoelectric ceramic (120) to produce a potential difference or an electric current (505). When the potential difference is high enough, electricity will be discharged through the explosive, i.e. will flow, across a gap (205) created by wires attached to the electrical connection (125).

Figure 5:
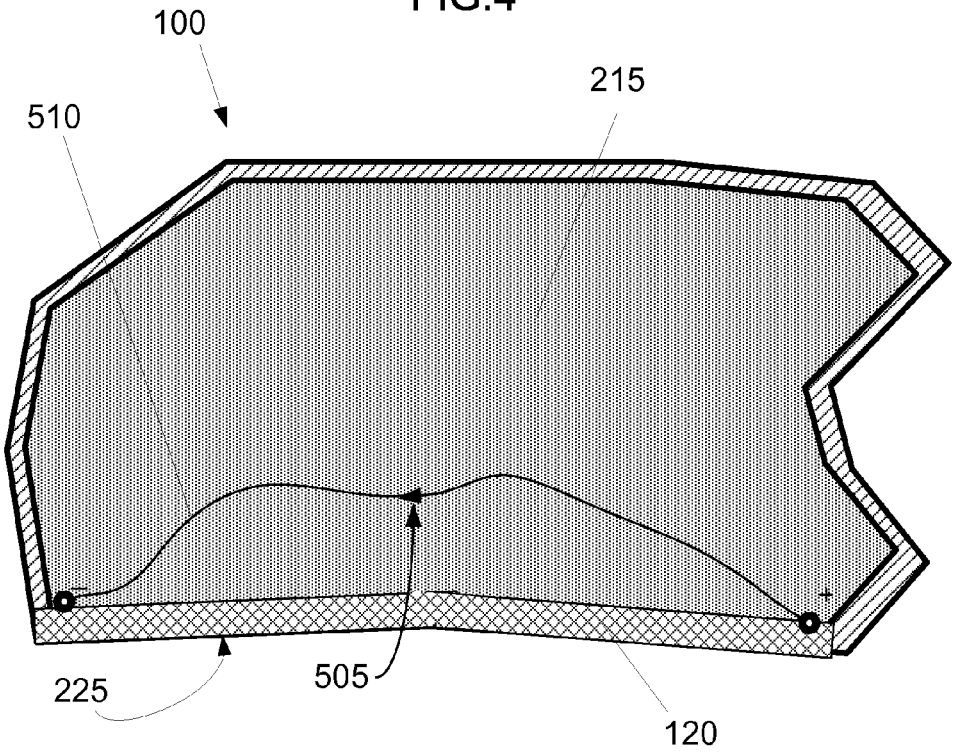
FIG. 5 is a sectional elevation view of an explosive device in the shape of an irregular rock where the piezoelectric ceramic is the bottom outer surface.

Alternatively, either a wire (510) as shown in FIG. 5, or the explosive (115) itself (not shown), may be used as a conductor to flow a current from a positive electrical terminal to a negative electrical terminal on the piezoelectric ceramic (120). Thus, the piezoelectric ceramic (120) either produces a potential difference, namely a voltage difference, or an electric current (505). Both may result in a current that flows using the electrical connection (125), namely, using the electrical terminals, on the piezoelectric ceramic (120).

The piezoelectric ceramic (120) may be the container itself, that is, it may form all or a part of an outer surface (225) of the container (105). FIG. 5 illustrates a piezoelectric ceramic (120) forming the bottom of the container (105) so that the piezoelectric ceramic (120) forms a portion of the outer surface (225) of the container (105).

For other preferred embodiments, the piezoelectric ceramic (120) is located within the inner volume (110) and is in some way connected to the container (105) so that any deformation of the container (105) also mechanically stresses the piezoelectric ceramic (120). For example, the piezoelectric ceramic (120) may span an inner diametric dimension of the container, attached to the shell and going from wall to wall of the shell.

The electrical connection (125) to the explosive (115) may include electrical conductors (220) spaced apart to form a gap (205) therebetween. A terminal block (not shown) may be used to fix the gap (205) to a particular distance. Preferably, the gap (205) is dimensioned to permit a spark (305) to cross the gap (205) when the piezoelectric ceramic (120) deforms a pre-designated amount. Values for compressive stress and the voltage generated by applying mechanical stress to a piezoelectric ceramic element are linearly proportional up to a material-specific stress. Thus, it is possible to design a gap between the electrical conductors (220) that cannot be crossed by a spark (305) until a predesignated amount of stress is applied to the piezoelectric ceramic (120). The voltage required to create a spark (305) across a gap (205) also depends on the resistivity of the environment where the gap (205) is found.

When the voltage difference between the conductors exceeds the gap's breakdown voltage, a spark forms. An electric current then flows until the current reduces below a minimum value called the "holding current." As an example, a gap distance of 0.19 millimeters in a device having a capacitance of 1200 picofarads, can produce ignition in an RD1333 explosive with a spark producing as little as 0.00035 Joules. In theory, a piezoelectric ceramic (standard PSI-5A sheet (1.5"×2.5"×0.0075")) can do 0.00035 joules of work in a quasi-static cycle.

Other components may be utilized to alter the operation of the explosive device. For example a capacitor may be added to accumulate charge and release it across the gap (205) when it is large enough to deliver sufficient energy for detonation of the specific explosive used in the explosive device (100). Another example is a delay circuit that may be added to delay the explosion for any amount of time after the compressive forces have been experienced. This might be used to explode under the rear end of a vehicle rather than under the front wheels causing the compression.

Figure 6:
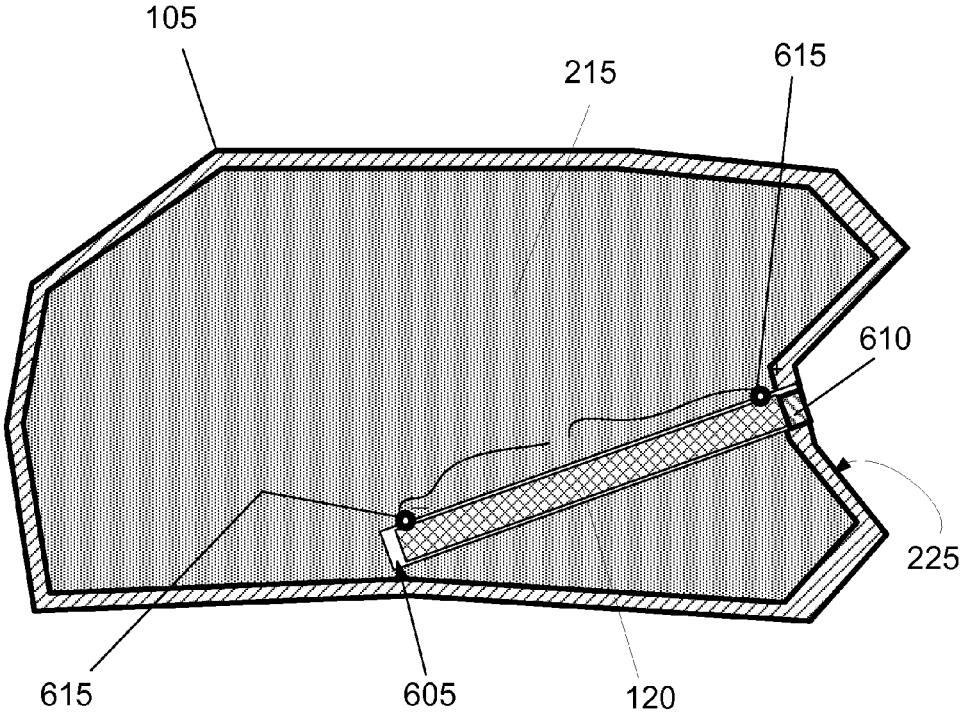
FIG. 6 is a sectional elevation view of an explosive device in the shape of an irregular rock where the piezoelectric ceramic is insertable into a cavity to arm the explosive device.

In an alternative embodiment shown in FIG. 6, the container (105) defines a cavity (605) extending into the inner volume (110) from the outer surface (225), the cavity (605) being in the shape of the piezoelectric ceramic (120) so that the piezoelectric ceramic (120) fits into the cavity to arm the explosive device (100). Each electrical connection (125) on the piezoelectric ceramic (120) mates up with a mating electrical connection (615) to enable operability of the explosive device (100), as described above. A cap (610) covers the cavity (605) to hold the piezoelectric ceramic (120). Thus, explosive device (100) comprises a container (105) that defines a cavity (605) extending into the inner volume (110) from an outer surface (225) of the container (105), the cavity (605) structured to receive the piezoelectric ceramic (120) to arm the explosive device (100).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the explosives industry.

What is claimed is:

1. An explosive device comprising:

a container structured with an irregular shape of a rock, the container defining an inner volume;

an explosive within the inner volume; and a piezoelectric ceramic having an electrical connection to the explosive; wherein a deformation of the container applies mechanical stress to the piezoelectric ceramic which produces a potential difference or an electric current discharged through the explosive using the electrical connection.

2. The explosive device of claim 1, wherein the piezoelectric ceramic is an outer surface of the container.

3. The explosive device of claim 1, wherein the piezoelectric ceramic is located within the inner volume.

4. The explosive device of claim 3, wherein the container comprises an outer surface that is an electrical insulator.

5. The explosive device of claim 1, wherein the container defines a cavity extending into the inner volume from an outer surface of the container, the cavity structured to receive piezoelectric ceramic to arm the explosive device.

6. The explosive device of claim 1, wherein the explosive is a plastic explosive.

7. The explosive device of claim 1, wherein the electrical connection to the explosive comprises electrical conductors spaced apart to form a gap therebetween, wherein the gap is dimensioned to enable a spark to cross the gap when the piezoelectric ceramic deforms a pre-designated amount.

* * * * *